US005764195A

United States Patent [19]

Colclough et al.

[11] Patent Number: 5,764,195

[45] Date of Patent: Jun. 9, 1998

[54] UHF/VHF MULTIFUNCTION OCEAN ANTENNA SYSTEM

[75] Inventors: Lindsley D. Colclough, Hingham; Richard J. Glenn, Abington, both of Mass.; Richard J. Kumpfbeck, Huntington, N.Y.

[73] Assignee: Hazeltine Corporation, Greenlawn, N.Y.

[21] Appl. No.: 685,812

[22] Filed: Jul. 24, 1996

[51] Int. Cl.[6] ..... H01Q 21/26

[52] U.S. Cl. ..... 343/797; 343/199; 343/803; 343/806; 343/814

[58] Field of Search ..... 343/793, 795, 343/797, 799, 803, 812, 814, 820, 729, 730, 806

[56] References Cited

U.S. PATENT DOCUMENTS

| | | | |
|---|---|---|---|
| 2,581,444 | 1/1952 | Richardson et al. | 343/799 |
| 3,312,902 | 4/1967 | Dean et al. | 343/709 |
| 3,972,046 | 7/1976 | Lombardi | 343/709 |
| 4,083,051 | 4/1978 | Woodward | 343/797 |
| 4,180,820 | 12/1979 | Johns | 343/797 |
| 4,434,425 | 2/1984 | Barbano | 343/797 |
| 5,187,488 | 2/1993 | Van Der Vis | 343/801 |
| 5,534,882 | 7/1996 | Lopez | 343/798 |

*Primary Examiner*—Donald T. Hajec
*Assistant Examiner*—Tho Phan
*Attorney, Agent, or Firm*—Edward A. Onders; Kenneth P. Robinson

[57] ABSTRACT

A multifunction antenna system is selectively operative over the UHF and VHF frequency ranges using a novel arrangement of symmetrically disposed phased radiating elements that function as a dipole turnstile type array at UHF and as a monopole at VHF. At VHF the UHF radiating elements and feedlines are fed in parallel against ground to produce a pattern similar to that of a short vertical monopole. VHF and UHF coupling networks offer low VSWR and minimize circuit losses when utilized with a folded dipole array. The compact, lightweight structure is adaptable to oceanic communications by installing in a towed radome adapted for water flotation, and provides low angle hemispherical UHF radiation without pattern switching, with the water surface providing a reflective ground plane.

22 Claims, 7 Drawing Sheets

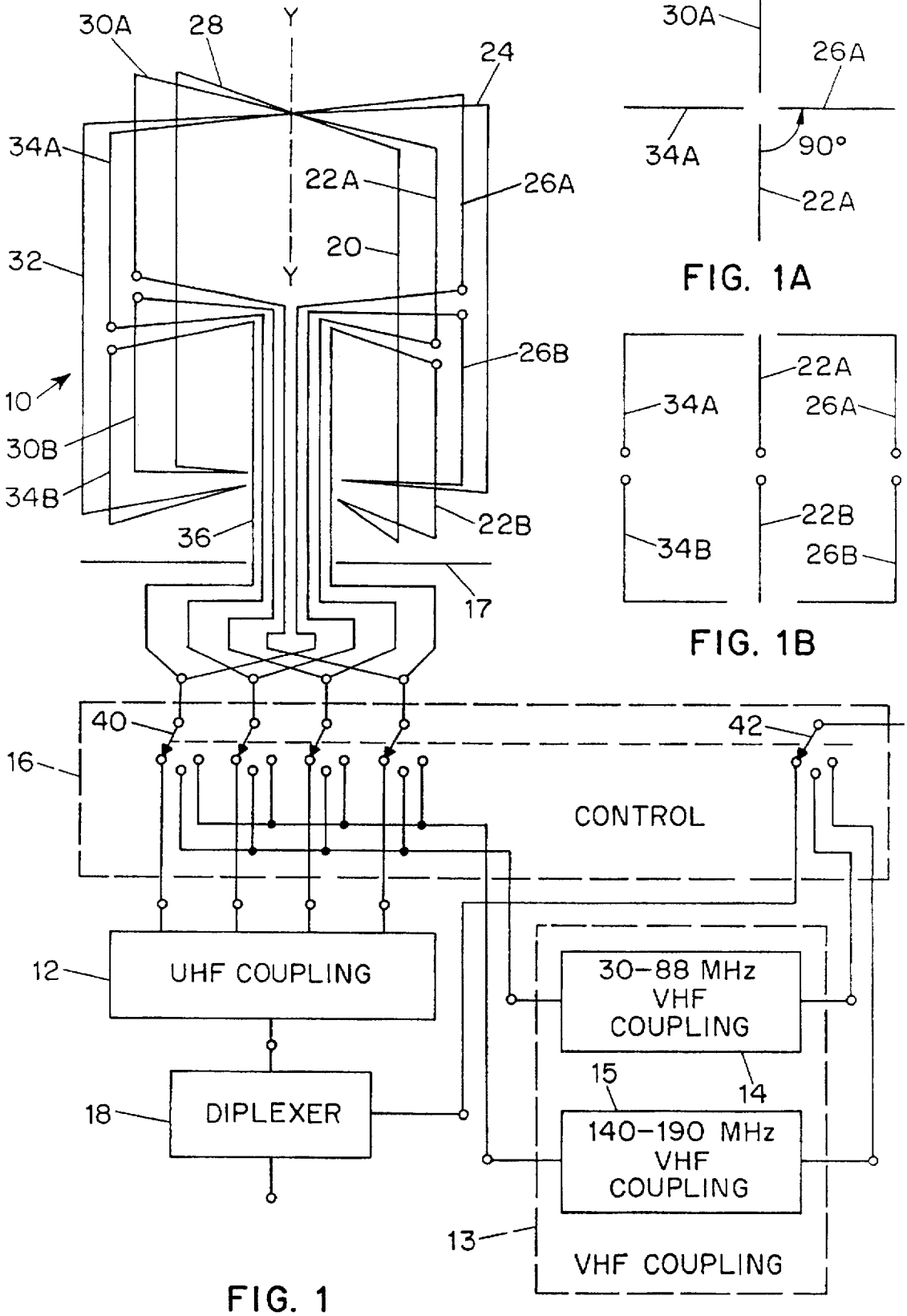
FIG. 1
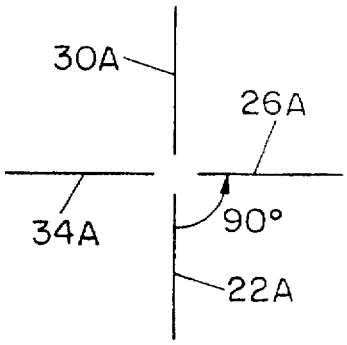
FIG. 1A
FIG. 1B

UHF/VHF MULTIFUNCTION OCEAN ANTENNA SYSTEM

The invention relates to omnidirectional antenna systems, and more particularly to a broadband antenna switchable between UHF and VHF frequency bands using common radiating elements.

BACKGROUND OF THE INVENTION

For UHF satellite communications, and particularly in an ocean environment, it is desirable to have a broadband antenna that maximizes gain in the horizontal plane at low elevation angles. This is particularly important for surface-to-surface and low elevation angle surface-to-air communications. It is further desirable for VHF communications to have a broadband antenna providing substantially constant gain as a function of frequency when used for frequency hopping mode reception in order to minimize receiver AGC settling time.

UHF antennas known in the prior art provide either low or high elevation angle coverage, but not hemispherical, and require active switching to select the desired angular coverage. VHF antennas may require retuning to cover a broad frequency range. The present invention provides hemispherical (i.e., covering both high and low elevation angles) coverage at UHF without requiring switching to achieve the desired pattern, and instantaneous wideband operation at VHF (i.e., without retuning) that results in a nearly constant received level. Further, prior art antennas required separate radiating elements to cover the VHF and UHF ranges. The present invention utilizes common elements for VHF and UHF coverage, thereby achieving economy in space, weight, and cost. The compact structure is adaptable to a flotation buoy for ocean communications.

It is therefore an object of this invention to provide an antenna structure which utilizes common radiating elements at VHF and UHF frequencies, thereby to minimize antenna volume and complexity.

It is a further object to provide UHF and VHF impedance matching networks that optimize antenna gain patterns without requiring retuning of the network over the designed frequency range.

It is a still further object to provide hemispherical UHF coverage with greater gain at low elevation angles with respect to the zenith to compensate for the greater path loss at the lower angles of elevation.

It is also an object to provide a compact, lightweight antenna system that can be integrated into a flotation buoy for ocean communications.

SUMMARY OF THE INVENTION

The invention comprises a broadband antenna system capable of being switched between VHF and UHF frequency bands and providing optimized radiation characteristics. In a preferred embodiment, four radiating elements are arranged outward from a central axis and separated by a nominal 90 degrees. Each radiating element includes upper and lower arms extending nominally parallel to the central axis and provided with a gap therebetween for connection to an antenna coupler, and having upper and lower distal portions which extend inward from the upper and lower arms, respectively, so that the radiating elements each comprise a dipole useful in the UHF range. In a further preferred embodiment, each radiating element includes first and second serially coupled members parallel to the central axis to form a folded dipole, thereby extending the bandwidth of the antenna.

The preferred embodiment further comprises a UHF coupling circuit arranged to couple nominally one quarter of the applied UHF signal to each of dipole radiating elements. By this configuration, a nominally 90 degrees phase difference is supplied to signals coupled to adjacent radiating elements.

The preferred embodiment also includes a VHF coupling circuit for matching a VHF signal to the radiating elements in a monopole feed configuration, by feeding the elements in parallel. Thus, signals of nominally the same phase are coupled to each radiating element.

Selection between the VHF and UHF coupling circuits is made by a suitable control circuit, responsive to an external command for connecting one of the UHF and VHF coupling circuits to the radiating elements in the manner heretofore described.

In a further preferred embodiment, the antenna system is installed in a radome enclosure configured for water flotation, so that the water surface acts as a ground plane with respect to the radiating elements.

In a still further preferred embodiment, the radome enclosure is provided with a tow bridle and signal coupling port so that the enclosure may be towed by a vessel while allowing signals to be coupled between the vessel and the antenna system.

Other objects, features and advantages of the present invention will be described herein with reference to the accompanying drawings, wherein like numerals refer to like elements.

BRIEF DESCRIPTION OF THE DRAWINGS

FIG. 1 is a block diagram showing a UHF/VHF antenna system in accordance with the present invention.

FIGS. 1A and 1B are simplified plan and side views, respectively, of the radiating elements of FIG. 1.

DESCRIPTION OF THE INVENTION

Figure 2:
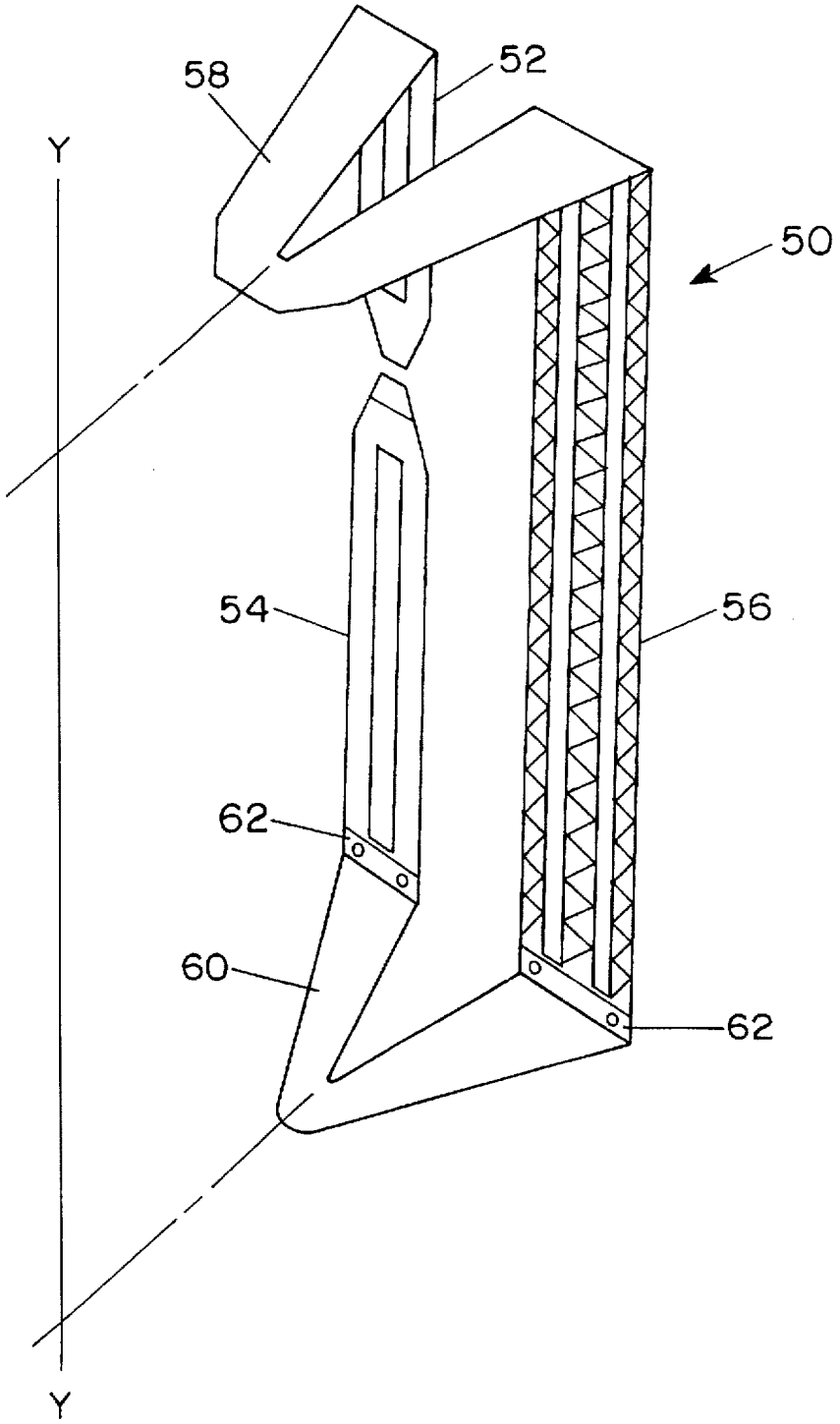
FIG. 2 is a perspective view of a folded-dipole antenna element usable in the embodiment of FIG. 1.

FIG. 1 is a block diagram showing a multifunction UHF/VHF antenna system of the invention. The antenna 10 comprises a plurality of radiating elements 20–34 disposed in a turnstile arrangement about a central axis y—y. Each radiating element is comprised of first and second serially connected members, with one of the members including upper and lower arms nominally parallel to the axis y—y.

Thus, for example, each radiating element is comprised, respectively, of members 20, 22A, 22B; 24, 26A, 26B; 28, 30A, 30B; and 32, 34A, 34B; where the suffix A denotes the upper arm and the suffix B denotes the lower arm. It may be seen that each pair of associated members therefore defines a folded dipole which may be appropriately excited by a signal applied to the segmented member. While a folded dipole is shown to illustrate the invention, it will be clear to one skilled in the art that the upper and lower arms of each radiating element (e.g., arms 22A and 22B) form a basic dipole radiating element, the folded dipole configuration as shown (i.e., including member 20) being provided to achieve improved operating bandwidth. Representations of the radiating elements are shown in FIGS. 1A and 1B, which are simplified plan and side views of the FIG. 1 radiating elements in a basic non-folded dipole format.

The respective segmented members of the antenna array are coupled via conductors 36 in a manner to be described to a control circuit shown as control box 16, which is provided with coupled relay contacts 40 and 42. Control box 16 is configured to connect selectively one of coupling circuits 12 and 13 to the radiating elements in accordance with selection of a predetermined frequency band. It will be shown that in the UHF coupling mode the radiating elements are fed in successive 90 degree relative phase and in the VHF modes in phase, as determined by the relay contact positions of control box 16. The antenna system also includes a circular metallic reflective ground plate represented at 17.

The structure of one embodiment of the radiating elements is shown most clearly in FIG. 2, which provides a perspective view of the assembly. In a preferred embodiment for the UHF frequency range, a stripline 50 having a total element length of 17.9" was folded to provide an input impedance of nominally 200 ohms. A first member is comprised of upper and lower arms 52 and 54 which are directly coupled to a second member 56 via upper and lower distal portions 58, 60 extending inward from the first and second members to a central axis Y—Y. The upper portion 58 has a distal length of 4.90" while the lower portion has a distal length of 3.50". Arms 52 and 54 are separated to provide a gap of 0.25" for accepting a signal feedline. This results in the height of member 56 and the combined arms 52 and 54 of 9.5", all the respective dimensions being nominal dimensions, as defined hereafter. Preferably, member 56 has a total width of 2.0" with 0.50" slots. Members 52 and 54 have a width of 0.50" with a spacing of 1.0" between the first and second members.

The entire radiating element may by formed by conventional stripline or printed circuit techniques. In the present embodiment the base material was 0.003" polyamide (trademarked Kapton) plated with one micron copper. Stiffener members 62 may optionally be provided at the folds of the base material.

Four such radiating elements disposed at 90° separations comprise a UHF/VHF antenna. The radiating elements operate as bent folded dipoles at UHF and may be optimized to provide maximum bandwidth. The elements are bent to provide hemispherical coverage with greater gain at lower angles of elevation than at the zenith to compensate for the greater propagation losses at the lower angles. In other embodiments conventional dipole elements such as represented in FIGS. 1A and 1B or other element designs may be utilized, phased as described, with appropriate impedance matching to meet particular bandwidth and other system requirements.

Figure 3:
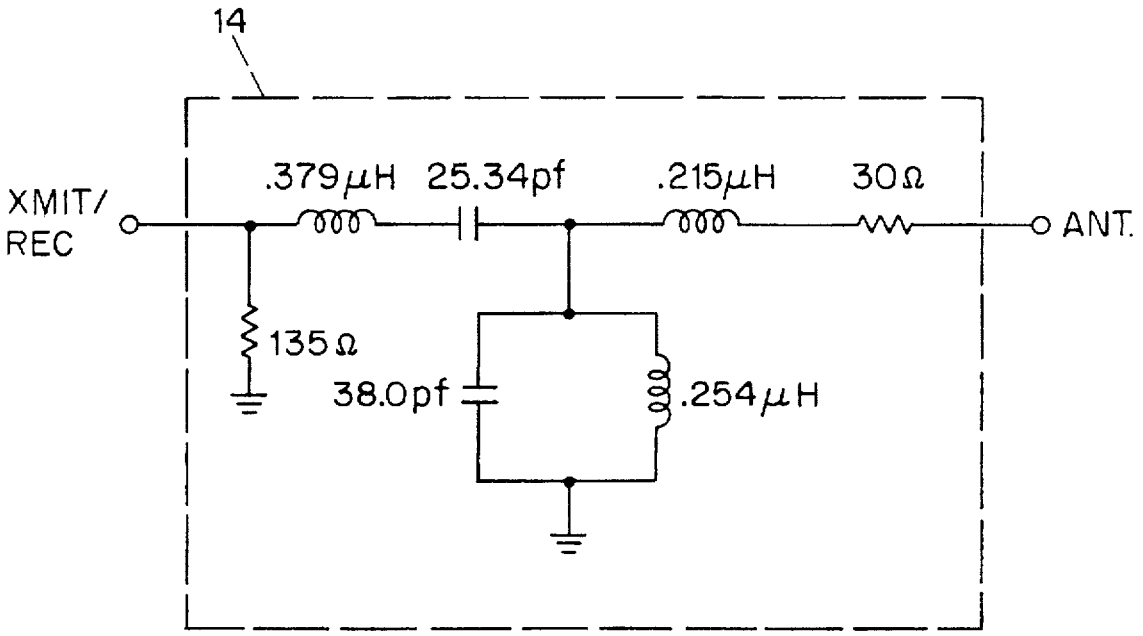
FIG. 3 is a schematic wiring diagram of a low-band VHF antenna matching network.
Figure 4:
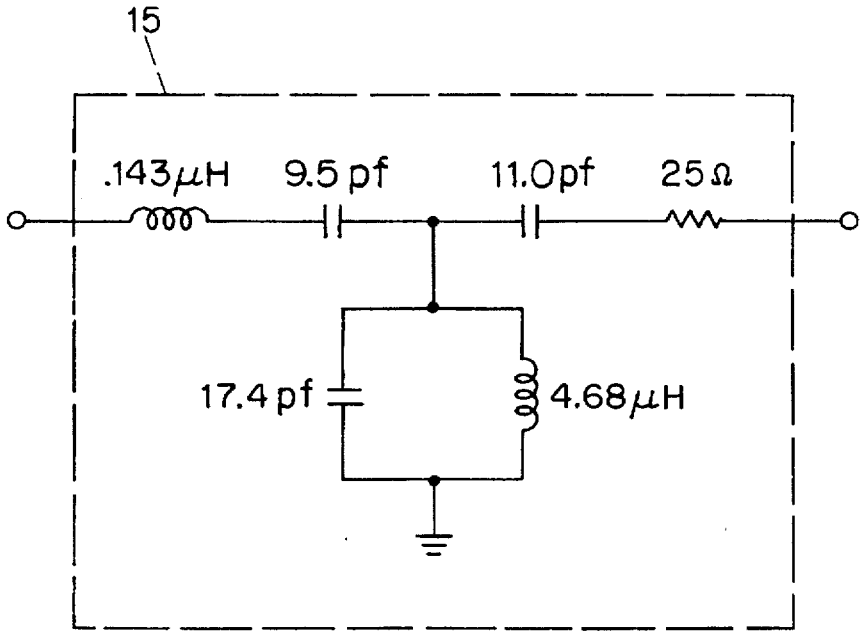
FIG. 4. is a schematic wiring diagram of a high-band VHF antenna matching network.

Referring now to FIGS. 3 and 4, with continued reference FIG. 1, there are shown circuit diagrams for low band and high band VHF impedance matching networks, respectively, as included in unit 13. As shown in FIG. 1, when either coupling network 14 or 15 is selected by relay contacts 42 of control unit 16, all antenna elements 20–34 are connected in parallel by relay contacts 40, thereby energizing the elements nominally in phase. Since the antennas operate reciprocally, either in transmit or in receive, this phase relationship will maintain throughout operation in the VHF ranges.

FIG. 3 shows a schematic diagram of an embodiment of a low band VHF matching circuit 14 for coupling a VHF signal to the radiating elements in a nominally 30 to 90 MHz band. This circuit was designed to provide a VSWR that varied from a high value of 2.2 at 40 MHz to a low value of 1.7 at 80 MHz, with an insertion loss varying from 24 dB at the low frequency end to 15 dB at the high frequency end. This resulted in an effective antenna gain of approximately −20 dB at 30 MHz and approximately −11 dB at 88 MHz, for a difference of about 9 dB. Since the propagation loss varies in an inverse manner over this frequency range, the result is to normalize the effective communication range with frequency.

In a similar manner, FIG. 4 is a schematic diagram of an embodiment of a high band VHF circuit 15 designed to match the parallel radiating elements over a nominal frequency band of 140 MHz to 190 MHz. VSWR was found to vary between 2.3 at 140 MHz to 1.6 at 180 MHz, while the insertion loss ranged from approximately −8 dB to −6 dB over the range. The corresponding antenna gain ranged from approximately −4.5 dB at 140 MHz to −2.5 dB at 180 MHz.

Figure 5:
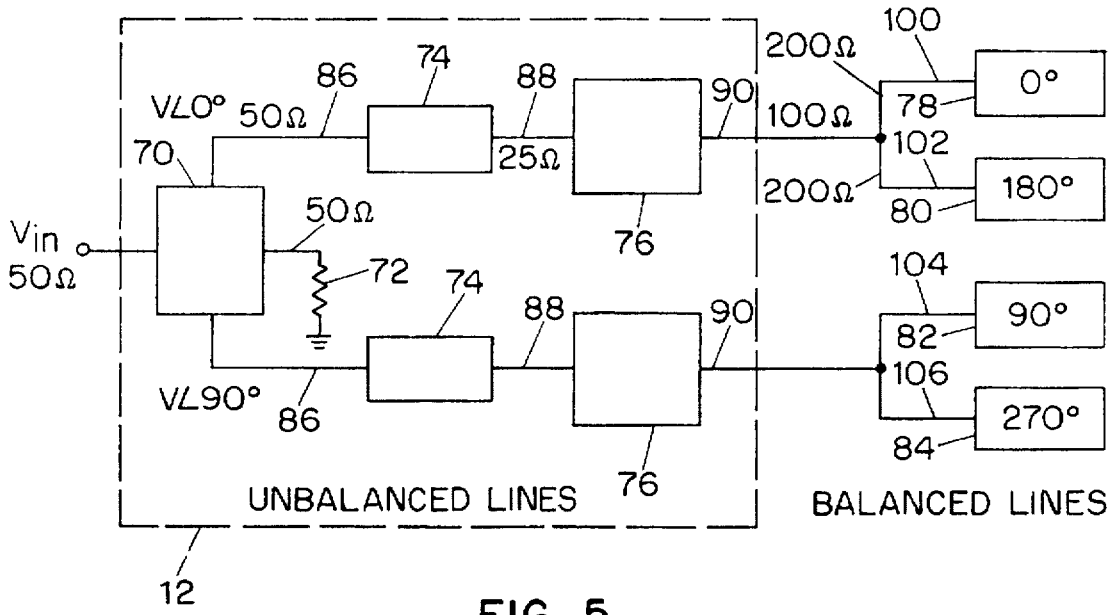
FIG. 5 is a block diagram of a UHF antenna coupler in accordance with the present invention.

FIG. 5 is a block diagram of an embodiment of a UHF matching network for use in the nominal 220–400 MHz frequency band and particularly adapted to matching an array of folded dipoles. Dipole antennas are preferably fed by balanced lines which are constructed symmetrically with respect to the feed point. In order to preserve symmetry with respect to ground, a balanced antenna should preferably be fed by a balanced feeder system. This avoids problems due to unbalanced currents and consequential undesirable radiation from the transmission line, which can distort the radiation pattern as well as interfere with associated electronics. Since the coaxial feed line is inherently unbalanced, the network of FIG. 5 is used to isolate the balanced load from the unbalanced line while permitting efficient power transfer. The network comprises a wideband 3 dB quadrature hybrid coupler 70, a high power isolated port terminating resistor 72, two coaxial ¼ λ impedance transformers 74, and two coaxial balun networks using Schiffman phase shifters 76. The signal Vin applied to the unbalanced 50 ohm input at coupler 70 is applied in phase opposition to transformers 74. The 25 ohm output thereof feeds the baluns 76 to provide a 100 ohm balanced output to the folded dipole antenna elements 100.

The hybrid coupler 70 comprises a quarter-wavelength twin center conductor coaxial cable, such as made by Sage Laboratories. This coupler distributes power to each coupler arm with a ratio of 0.5 dB at 400 MHz, the worst case. No noticeable degradation of performance is caused by this small asymmetry between the branches. The line lengths of the coupler 70, transformers 74, and phase shifter 76 are preferably set to a center frequency of 300 MHz. With a typical application applying a peak power of 100W for a duty cycle of ⅙, a termination capable of dissipating 35W average power is suitable.

Quarter wave transformer 74 is used to transform the impedance from 50 ohms to a nominal value of 25 ohms, and may be formed from 32 or 35 ohm flexible or rigid coaxial cable. The 35 ohm cable provides a more accurate impedance transformation to the desired 25 ohm value, since the 32 ohm cable will result in an output impedance of approximately 20 ohms, resulting in a 1.2:1 mismatch at the center frequency.

Figure 6:
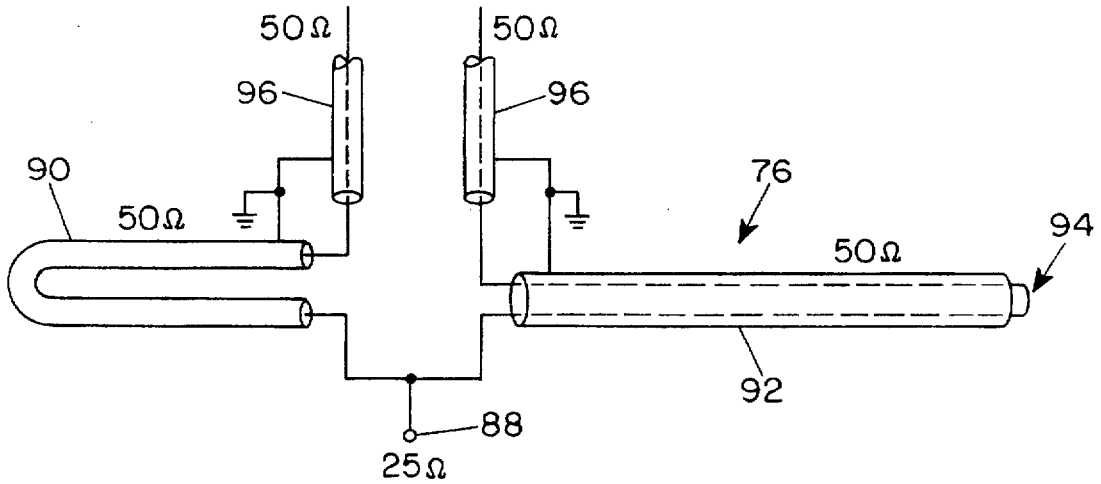
FIG. 6 is a detail of a wideband coaxial balun as used in the coupler of FIG. 5.

Referring now to FIG. 6, each coaxial balun network comprises a one-half wavelength length of RG/U 316 50 ohm cable 90 in parallel with a half wavelength of Wireline twin center conductor 50 ohm coaxial cable 92. The center conductors of cable 92 are shorted as shown at reference 94, and the two cables are connected in parallel at the 25 ohm input. This creates a 360° path length through the coupled lines and provides a 4:1 impedance transformation at the output. Thus, the 100 ohm output is coupled to two 50 ohm coaxial cables 96. This balun is known as a Schiffman phase shifter and produces a 180° phase shift between the two output ports. Thus, equal and opposite voltage polarities to ground are obtained for the balanced lines that follow.

Figure 7:
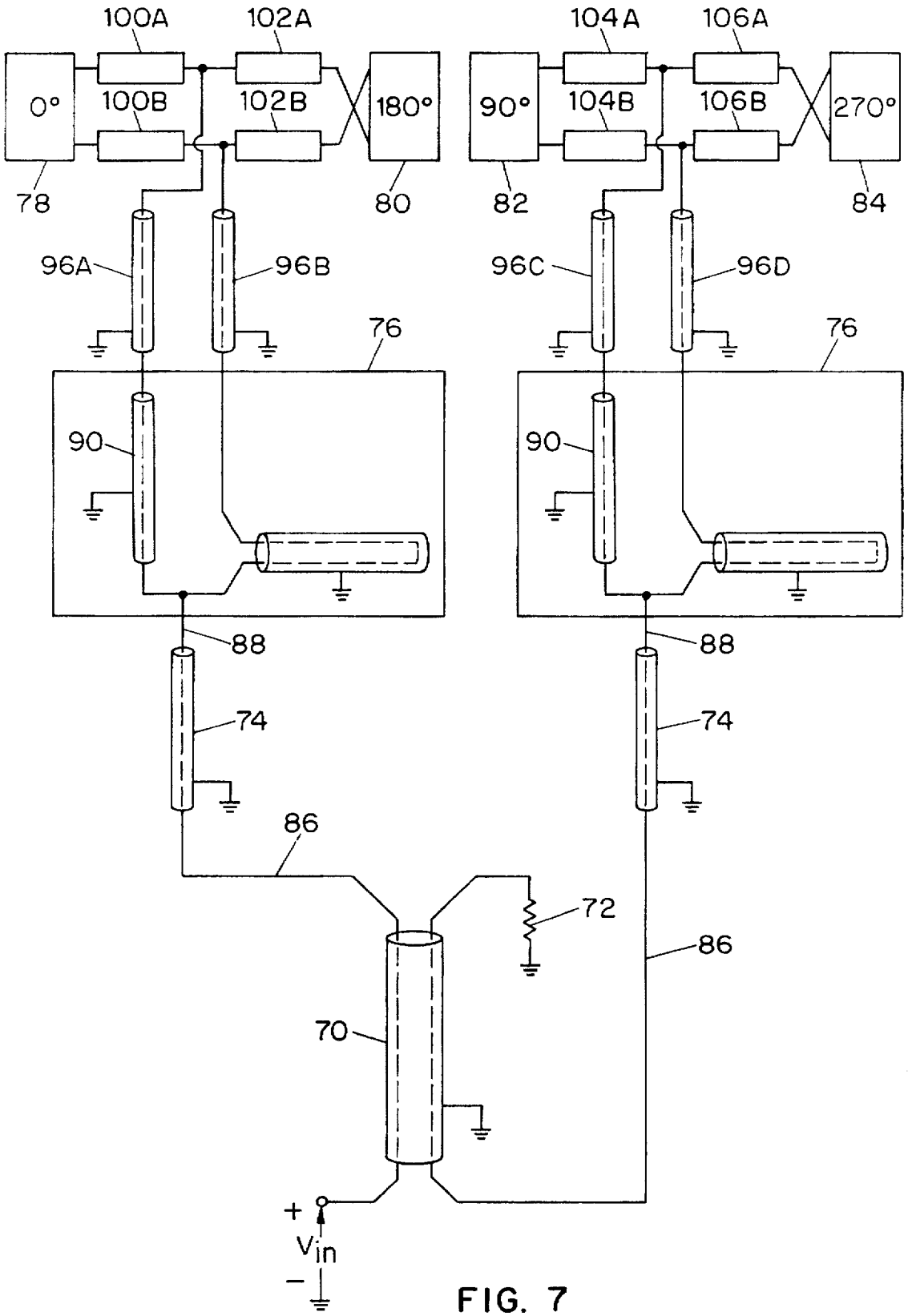
FIG. 7 is a schematic wiring diagram of a UHF antenna coupler as in the present invention.

The operation of the UHF antenna coupler 12 may be understood by reference to FIG. 7. At the input Vin, the wideband coupler 70 nominally splits the power evenly and provides a 90° phase shift to impedance transformers 74. The 50 ohm quarter wave transformers operate in a conventional manner to provide a 25 ohm output from a 50 ohm input. This provides a match to the 25 ohm input of the wideband balun 76, which has two 50 ohm lines in parallel as the input. The balun, as heretofore described, converts the network from an unbalanced to a balanced configuration over a 2:1 frequency band (200–400). The balun output voltages are equal and opposite with respect to ground and effectively convert four 50 ohm transmission lines 90 into two shielded 100 ohm twin lead lines 96A–96D that travel from the coupler housing to a height equal with the antenna feedpoints. Each branch then splits a second time into two parallel 200 ohm coplanar balanced lines 100A–100B, 102A–102B, 104A–104B and 106A–106B, that run from the center conductor to the radiating elements. The two outputs 78, 80 and 82,84 corresponding to each pair of 200 ohm lines are phase inverted. Depending then on which port of coupler 70 is terminated in 50 ohms (e.g., at 72), the array can provide left or right hand circular polarization having substantially hemispheric coverage.

It will be clear to one skilled in the art that it is advantageous to use a folded dipole as the radiating element in this configuration. When a center-fed half-wave dipole with a characteristic impedance of about 72 ohms is modified to a two-wire folded half wave dipole, as in FIG. 2, the effect is to multiply the input impedance by a factor of four to approximately 280 ohms. This is more appropriate for the matching network of this invention and alleviates the need for additional matching components, reducing cost and complexity. With the present invention, the radiating elements are well matched to the 200 ohm coplanar line, not exceeding a VSWR of 2:1 over 240–270 MHz. Performance rolls off to about a 4:1 mismatch at 400 MHz.

Figure 8:
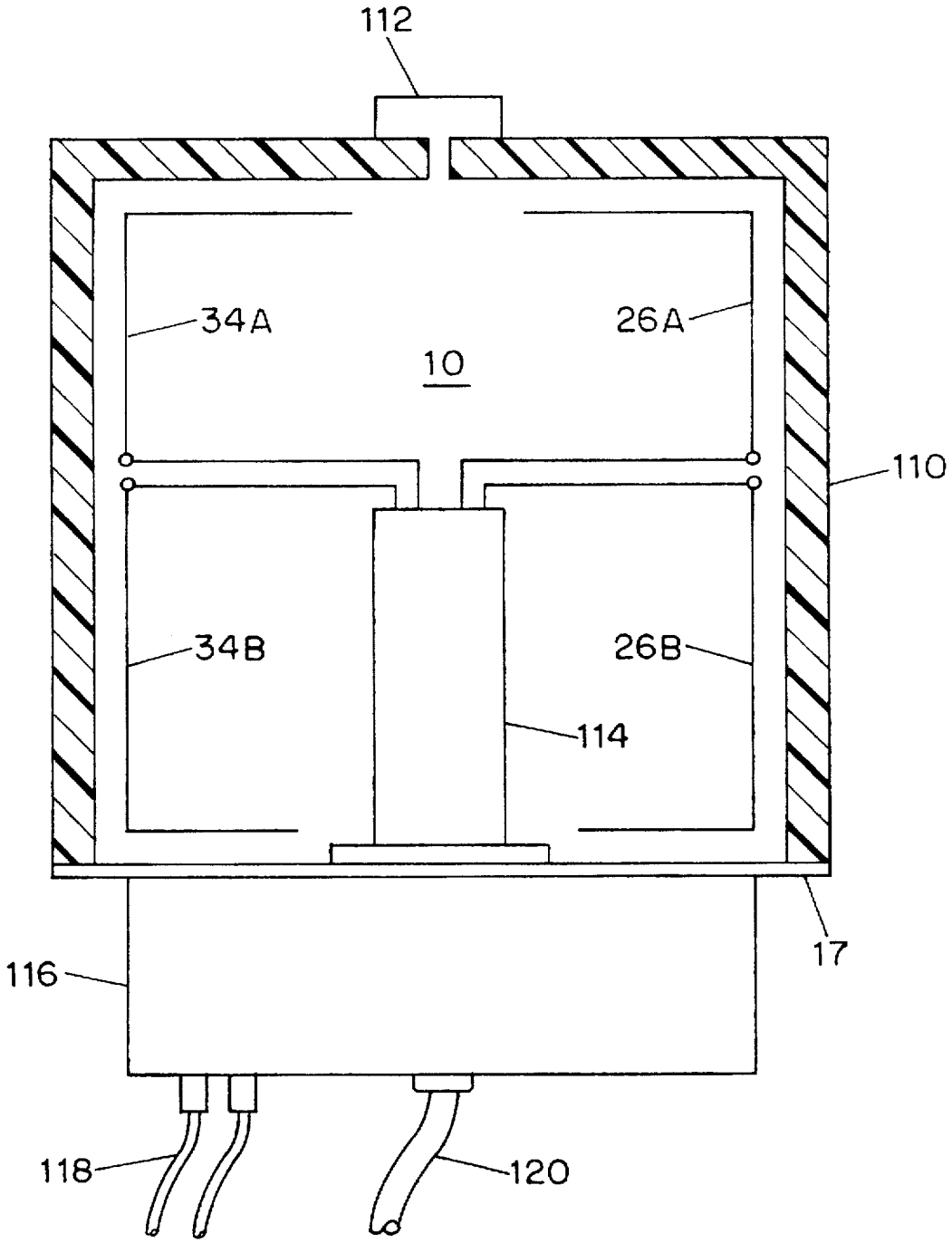
FIG. 8 is a sectional view of an antenna system of the present invention as installed in a radome for use with an external VHF antenna.

The compact nature of the UHF coupling network and antenna array lends itself to utility with a radiation-transmissive radome 110 of overall dimensions of 12 inches in height and 12 inches in diameter, as shown in cross-section in the simplified view of FIG. 8. Preferably, a circular reflective ground plate 17 having a nominal 12 inch diameter will be suitable at UHF frequencies. The radome may be utilized at VHF by collectively exciting the radiating elements of antenna 10 as a monopole, cooperating with the reflecting ground plane, as heretofore described, and additional capabilities may be provided via an external antenna or other sensor, such as a global position system antenna, mounted atop the radome at antenna mount 112. Other appropriate physical arrangements, such as feed and electrical housings 114 and 116, RF connections 118 and power connection 120, can be provided by skilled persons.

Figure 9:
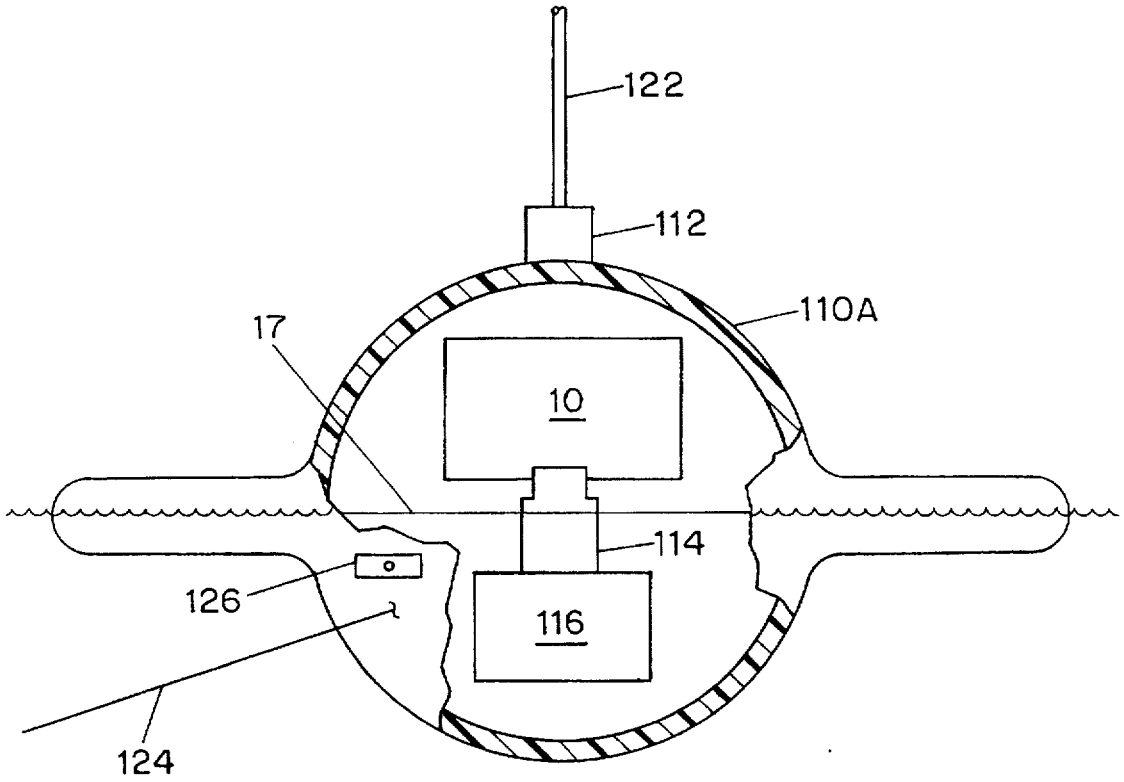
FIG. 9 is a sectional view of the present invention as installed in a flotation buoy for oceanic communications.

In another preferred embodiment, an antenna system in accordance with the invention may by enclosed within a radome/housing 110A and supported for floatation above the surface of the ocean, as in FIG. 9. Here the water surface acts as a reflecting ground plane with ground plate 17, and the floatation device enables operation over a range of sea conditions. A whip antenna 122 is shown affixed to antenna mount 112.

Figure 10:
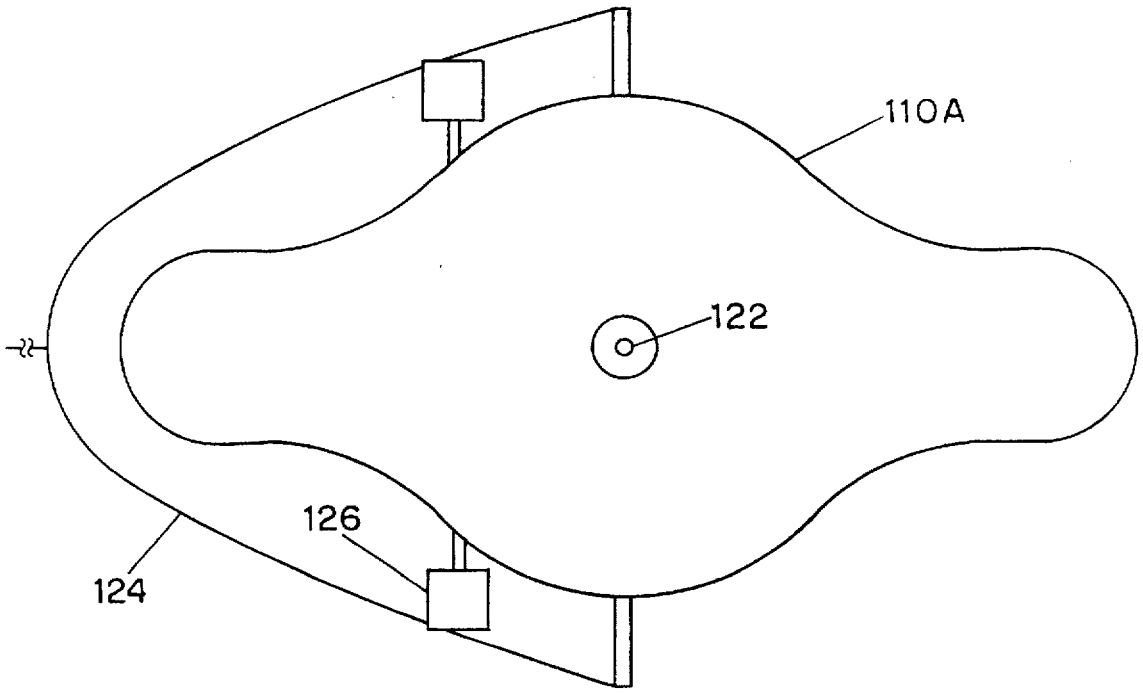
FIG. 10 is a conceptual pictorial of the invention of FIG. 9 as utilized with a tow bridal.

When used with the radome enclosure and floatation device, the apparatus is suitable to be provided with a tow line connection assembly 124 as in FIG. 10, thus enabling the enclosure to be towed by a vessel. Signals can be coupled between the vessel and the antenna system by suitable cabling (not shown) which is configured to cooperate with the tow line assembly. Control planes 126 may be included to permit adjustment of the tow attitude.

For the purposes of this invention:

"nominally" is defined as encompassing arrangements within about plus or minus 20 percent of a stated value or relationship.

"UHF signal" is defined as a signal within a range of frequencies, which range includes at least a portion of the band from 220 to 400 MHz.

"VHF signal" is defined as a signal within a range of frequencies, which range includes at least a portion of the band from 30 to 190 MHz.

While there have been described the currently preferred embodiments of the invention, those skilled in the art will recognize that other and further modifications may be made without departing from the invention and it is intended to claim all modifications and variations as fall within the scope of the invention.

What is claimed is:

1. A UHF/VHF antenna system comprising:

four radiating elements located outward from and around a central axis at nominally 90 degree separations, each of said radiating elements including upper and lower arms extending nominally parallel to said central axis, and having upper and lower distal portions extending inward from said upper and lower arms, respectively, each said radiating element comprising a dipole for UHF band use;

a UHF coupling circuit responsive to a UHF signal and configured to couple nominally one-quarter of said UHF signal to each of said radiating elements in a dipole feed configuration, with nominally 90 degrees phase difference, between signals coupled to adjacent radiating elements;

a VHF coupling circuit responsive to a VHF signal and configured to couple portions of said VHF signal to each of said radiating elements in a monopole feed configuration, with signals of nominally the same phase coupled to each radiating element; and a control circuit configured to connect selectively one of said UHF and VHF coupling circuits to said radiating elements.

2. A UHF/VHF antenna system as in claim 1, wherein said central axis is nominally vertical and said upper and lower distal portions extend inward nominally horizontally.

3. A UHF/VHF antenna system as in claim 1, wherein said central axis is nominally vertical, each of said radiating elements comprises upper and lower arms together extending nominally 9.5 inches vertically, with said upper distal portion of said upper arm extending nominally 4.9 inches inwardly and said lower distal portion of said lower arm extending nominally 3.5 inches inwardly.

4. A UHF/VHF antenna system as in claim 3, wherein said antenna system additionally comprises the combination of a radiation-transmissive radome and a circular reflective ground plate, having nominal outside dimensions of 12 inches in height and 12 inches in diameter.

5. A UHF/VHF antenna system as in claim 1, wherein each of said radiating elements comprises a printed conductive pattern on an insulative support foldable to provide vertically extending upper and lower arms with horizontally extending respective upper and lower distal portions.

6. A UHF/VHF antenna system as in claim 1, wherein said UHF coupling circuit comprises a 3 dB quadrature hybrid coupler having: a first output to a first signal splitter providing 0 degree and 180 degree phase signal outputs which are coupled respectively to a 0 degree radiating element and, with phase reversal, to a 180 degree radiating element; and a quadrature output to a second signal splitter providing 90 degree and 270 degree phase signal outputs which are coupled respectively to a 90 degree radiating element and, with phase reversal, to a 270 degree radiating element.

7. A VHF/UHF antenna system as in claim 6, wherein said UHF coupling circuit is configured for coupling said UHF signal in the nominal 225 to 400 MHz band to said radiating elements.

8. A UHF/VHF antenna system as in claim 6, wherein said 0, 90, 180 at 270 degree radiating elements are positioned in one of: clockwise relationship to radiate a right-hand circularly polarized signal; counter-clockwise relationship to radiate a left-hand circularly polarized signal.

9. A UHF/VHF antenna system as in claim 1, wherein said VHF coupling circuit is configured to couple said VHF signal to said radiating elements with said radiating elements collectively excited as a monopole radiator cooperating with a reflecting ground plane.

10. A UHF/VHF antenna system as in claim 9, additionally comprising an enclosure configured for water flotation with the water surface comprising said reflecting ground plane.

11. A UHF/VHF antenna system as in claim 1, wherein said VHF coupling circuit comprises a low band VHF matching circuit for coupling said VHF signal in a nominally 30 to 90 MHz band to said radiating elements and a high band VHF matching circuit for coupling said VHF signal in a nominally 140 to 190 band to said radiating elements, and said control circuit is additionally configured to connect selectively one of said low and high band VHF matching circuits to said radiating elements for use with a respective one of said low and high band signals.

12. A UHF/VHF antenna system as in claim 1, additionally comprising an enclosure configured for water flotation with said radiating elements supported in a position to enable the water surface to provide an antenna ground plane.

13. A VHF/UHF antenna system as in claim 12, additionally comprising a tow line connection device and signal coupling port enabling said enclosure to be towed by a vessel and signals to be coupled between said vessel and said antenna system.

14. A UHF/VHF antenna system as in claim 1, wherein: each of said radiating elements further comprises a first member serially coupled to a second member, said first member comprised of said upper and lower arms, said first and second members extending nominally parallel to said central axis and having upper and lower distal portions extending toward said central axis, each said radiating element comprising a folded dipole for UHF band use.

15. A UHF/VHF antenna system comprising:

four radiating elements located outward from and around a central axis at nominally 90 degree separations, each of said radiating elements including upper and lower arms extending nominally parallel to said central axis, each said radiating element comprising a dipole for UHF band use;

a UHF coupling circuit responsive to a UHF signal and configured to couple nominally one-quarter of said UHF signal to each of said radiating elements in a dipole feed configuration, with nominally 90 degrees phase difference between signals coupled to adjacent radiating elements;

a VHF coupling circuit responsive to a VHF signal and configured to couple portions of said VHF signal to each of said radiating elements in a monopole feed configuration, with signals of nominally the same phase coupled to each radiating element;

a control circuit configured to connect selectively one of said UHF and VHF coupling circuits to said radiating elements; and a reflective ground plate.

16. A UHF/VHF antenna system as in claim 15, wherein said UHF coupling circuit comprises a 3 db quadrature hybrid coupler having: a first output to a first signal splitter providing 0 degree and 180 degree phase signal outputs which are coupled respectively to a 0 degree radiating element and, with phase reversal, to a 180 degree radiating element; and a quadrature output to a second signal splitter providing 90 degree and 270 degree phase signal outputs which are coupled respectively to a 90 degree radiating element and, with phase reversal, to a 270 degree radiating element.

17. A UHF/VHF antenna system as in claim 16, wherein said 0, 90, 180 and 270 degree radiating elements are positioned in one of: clockwise relationship to radiate a right-hand circularly polarized signal; counter-clockwise relationship to radiate a left-hand circularly polarized signal.

18. A UHF/VHF antenna system as in claim 15, wherein said VHF coupling circuit is configured to couple said VHF signal to said radiating elements with said radiating elements collectively excited as a monopole radiator cooperating with a reflecting ground plane.

19. A UHF/VHF antenna system as in claim 15, wherein said VHF coupling circuit comprises a low band VHF matching circuit for coupling said VHF signal in a nominally 30 to 90 MHz band to said radiating elements and a high band VHF matching circuit for coupling said VHF signal in a nominally 140 to 190 band to said radiating elements, and said control circuit is additionally configured to connect selectively one of said low and high band VHF matching circuits to said radiating elements for use with a respective one of said low and high band signals.

20. An antenna system including four radiating elements located outward from and around a vertical central axis at nominally 90 degree separations, wherein each of said radiating elements comprises:

a folded dipole for UHF band use having a predetermined length with upper and lower distal portions extending inwardly, so that the folded dipole has a reduced overall height;

the folded dipole including a first member serially coupled to a second member, the first member comprised of upper and lower arms, said members extending nominally parallel to said central axis and including said upper and lower distal portions, which extend inwardly nominally perpendicular to said central axis; and the folded dipole being of said predetermined length, which is equal to said overall height, plus the lengths of the upper and lower distal portions.

21. An antenna system as in claim 20, wherein each of said radiating elements comprises a printed conductive pattern on an insulative support foldable to provide vertically extending upper and lower arms with horizontally extending respective upper and lower distal portions.

22. An antenna system as in claim 20, wherein said central axis is nominally vertical, each of said radiating elements comprises upper and lower arms together extending nominally 9.5 inches vertically, with said upper distal portion of said upper arm extending nominally 4.9 inches inwardly and said lower distal portion of said lower arm extending nominally 3.5 inches inwardly.

* * * * *